US005910079A

United States Patent [19]

Watanabe

[11] Patent Number: 5,910,079

[45] **Date of Patent: *Jun. 8, 1999**

[54] METHOD AND APPARATUS FOR MANUFACTURING PAPER CUSHIONING MEMBERS

[75] Inventor: Tokuji Watanabe, Kawaguchi, Japan

[73] Assignee: Strapack Corporation, Saitama-ken, Japan

[ * ] Notice: Under 35 U.S.C. 154(b), the term of this patent shall be extended for 545 days.

[21] Appl. No.: 08/531,069

[22] Filed: Sep. 20, 1995

Related U.S. Application Data

[63] Continuation-in-part of application No. 08/165,474, Dec. 13, 1993, abandoned.

[30] Foreign Application Priority Data

Dec. 14, 1992 [JP] Japan ..... 4-353576
May 11, 1993 [JP] Japan ..... 5-132734

[51] Int. Cl.[6] ..... B31B 1/14

[52] U.S. Cl. ..... 493/352; 493/464; 493/967

[58] Field of Search ..... 493/967, 370, 493/369, 365, 364, 363, 35 R, 464, 356, 352, 357, 465

[56] References Cited

U.S. PATENT DOCUMENTS

| | | | |
|---|---|---|---|
| 671,915 | 4/1901 | Curtis | 83/332 |
| 797,221 | 8/1905 | Price | 72/186 |
| 1,344,826 | 6/1920 | Sexton . | |
| 1,384,376 | 7/1921 | Arey . | |
| 1,850,543 | 3/1932 | Gersman . | |
| 2,770,302 | 11/1956 | Lee | 493/370 |
| 3,033,064 | 5/1962 | Lee | 493/365 |
| 3,162,942 | 12/1964 | Christman | 29/455 |
| 3,329,049 | 7/1967 | Hubbard | 83/332 |
| 3,408,735 | 11/1968 | Eisler | 72/186 |
| 3,650,877 | 3/1972 | Johnson | 161/47 |
| 4,615,671 | 10/1986 | Bernal | 83/332 |
| 4,621,397 | 11/1986 | Schrenk | 29/6.1 |
| 4,650,456 | 3/1987 | Armington | 493/464 |
| 5,088,972 | 2/1992 | Parker | 493/967 |
| 5,134,013 | 7/1992 | Parker | 493/967 |
| 5,173,352 | 12/1992 | Parker | 428/174 |
| 5,340,638 | 8/1994 | Sperner | 493/967 |
| 5,365,819 | 11/1994 | Maida et al. | 83/332 |
| 5,403,259 | 4/1995 | Parker | 493/352 |

FOREIGN PATENT DOCUMENTS

| | | |
|---|---|---|
| 0602580 | 6/1994 | European Pat. Off. . |
| 6179471 | 6/1994 | Japan . |
| 6320647 | 11/1994 | Japan . |

*Primary Examiner*—James F. Coan
*Assistant Examiner*—Gene L. Kim
*Attorney, Agent, or Firm*—Greenblum & Bernstein P.L.C.

[57] ABSTRACT

A method and apparatus for manufacturing paper cushioning members in which work paper is inserted between a pair of intermittent-cutting roller members to process multiple rows of thin bands with link portion. Waste-collecting members are provided at a discharge side of the rollers to separate the work paper from the roller members and to feed the processed work paper into a wave-forming guide. The wave-forming guide includes an upper pressing member that rotates about a hinge positioned at an end nearest to the discharge side of the rollers and a counterweight positioned at a distal end of said upper pressing member such that the upper pressing member is biased toward the interior of the wave-forming guide. The wave-forming guide is designed to forcibly compress the processed work paper into finely crumpled thin bands and to discharge the crumpled thin bands in a wavy form.

1 Claim, 16 Drawing Sheets

111211
WWW
P'
7n
7
7
7

METHOD AND APPARATUS FOR MANUFACTURING PAPER CUSHIONING MEMBERS

This application is a continuation-in-part of application Ser. No. 08/165,474, filed Dec. 13, 1993, now abandoned.

BACKGROUND OF THE INVENTION

1. Field of the Invention

The present invention relates to a method and apparatus for manufacturing paper cushioning members, and more particularly, to a method and apparatus for cutting a single sheet or plural sheets of work paper to be processed, such as unused paper or unnecessary newspaper, used copying paper, paper printed by an OA (Office Automation) equipment or used corrugated cardboard, to plural rows of thin intermittently-cut bands, stretching the resultant sheet or sheets of work paper to form a net, and crumpling the net-like sheet or sheets into an air-containing ball which has an adequate softness to thereby ensure continuous mass-production of such paper balls and permit the use of the paper balls as cushions or packings for transporting objects.

2. Description of the Related Art

There are cushions made of synthetic resin, which are to be placed between transporting objects and a box to protect the transporting objects against any damage. To avoid any pollution problem, however, there are paper cushions used for the same purpose instead of the synthetic-resin cushions. The simplest type of the paper cushions is a sheet of newspaper crumpled into a ball or paper torn to pieces which are then crumpled, or a corrugated cardboard cut into pieces as an intervening material depending on the usage.

Another known cushion is a strong kraft paper processed to have short cuts and link portions by press working and then stretched to yield a fine almost beehive-like net.

Of those paper cushions, the first type, namely balls made of newspaper, involve a troublesome work and are likely to vary in quality. Although the torn and crumpled pieces of paper, the second type, are soft to serve as good cushions, they are independent piece by piece and are easy to scatter, resulting in a lower working efficiency. In addition, since it is difficult to use the torn and crumpled pieces of paper directly, they are normally placed in a paper bag or a poly bag when in use. If the bag is torn or broken, however, the crumpled pieces of paper undesirably come out of the bag through the torn section.

Although a corrugated cardboard, when cut to pieces, ensure an even thickness, those pieces are still hard and are not so suitable as cushions.

With regard to the pressed kraft paper or the last type of cushion, when the processed kraft paper is stretched, a fine beehive-like net is formed due to the cuts and link portions. When the net is crumpled, soft and spongy feeling to some degree would be attained. Due to the press working, however, the processing size of a single sheet of kraft paper is limited and it is not possible to simultaneously process plural sheets of kraft paper. Further, as the resultant net is finely formed, the horizontal stretching ratio is small, so that the net, when crumpled into a ball, contain less air. Furthermore, as the link portions are short, the link portions are easily cut when stretched unless the kraft paper is very strong. Tn addition, as the net is finely formed, the material should be a thin sheet of paper and the net should be formed sheet by sheet.

SUMMARY OF THE INVENTION

It is therefore an object of the present invention to provide a method and apparatus for manufacturing paper cushioning members, which will overcome the above-described conventional shortcomings.

To achieve the above object, according to one aspect of this invention, there is provided a method of manufacturing paper cushioning members, comprising the steps of forming circumferential recesses and projections each of a given width on and around a surface of each of a pair of elongated roller members and engaging the recesses and projections of one of the roller members with those of the other roller member respectively; forming link-portion forming recesses each in a part of a circumferential surface of each of the projections in a horizontal direction or at a predetermined angle to the horizontal direction; inserting a single sheet or plural sheets of work paper to be processed between the pair of roller members and alternately forming cuts and link portions along the circumferential recesses and projections on the sheet or sheets of work paper, by using circumferential edges of the circumferential recesses and projections of the roller members; and stretching the sheet or sheets of work paper after alternate formation of the cuts and link portions in a direction perpendicular to a cutting direction, thus forming a net.

According to another aspect of this invention, there is provided an apparatus for manufacturing paper cushioning members, comprising a pair of elongated roller members having circumferential recesses and projections each of a given width thereon and therearound; cutting blades formed at peripheral edges of surfaces of the circumferential projections; and link-portion forming recesses formed each in a part of a circumferential surface of each of the projections in a horizontal direction or at a predetermined angle to the horizontal direction, whereby with the recesses and projections of one of the roller members engaged with those of the other roller member respectively, when a single sheet or plural sheets of work paper to be processed are inserted in the engaging portion between the roller members, cuts and link portions are alternately formed along the cutting blades by using circumferential edges of the circumferential recesses and projections of the roller members, and the sheet or sheets of work paper after alternate formation of the cuts and link portions in a direction perpendicular to a cutting direction, thus forming a net.

The apparatus according to the second aspect of this invention may be designed in such a way that the link-portion forming recesses are formed, all facing in one direction, in the circumferential projections.

The apparatus according to the second aspect of this invention may also be designed in such a way that the link-portion forming recesses are formed in facing surfaces of those of the circumferential projections which are adjacent to each other.

Alternatively, the apparatus according to the second aspect of this invention may be designed in such a way that the link-portion forming recesses are formed entirely across the circumferential projections in a horizontal direction.

The apparatus according to the second aspect of this invention may further be designed in such a way that the link-portion forming recesses are formed entirely across the circumferential projections, inclined at a predetermined angle to a horizontal direction.

According to a different aspect of this invention, there is provided a container for paper cushioning members, comprising a paper-retaining container body having an openable/closable cover; and a take-out port formed in a front or side of the container body and having such a size as to allow insertion of a hand, whereby processed net-like paper cushioning members obtained by forming cuts and link portions in each work paper to be processed are retainable in the container body with that side of the net-like paper cushioning members along a cutting direction facing perpendicular to the take-out port and a desired number of sheets of the net-like paper cushioning members can be pulled out through the take-out port, so that when each of the net-like paper cushioning members is pulled out, a net is formed.

DETAILED DESCRIPTION OF THE PREFERRED EMBODIMENTS

Figure 1:
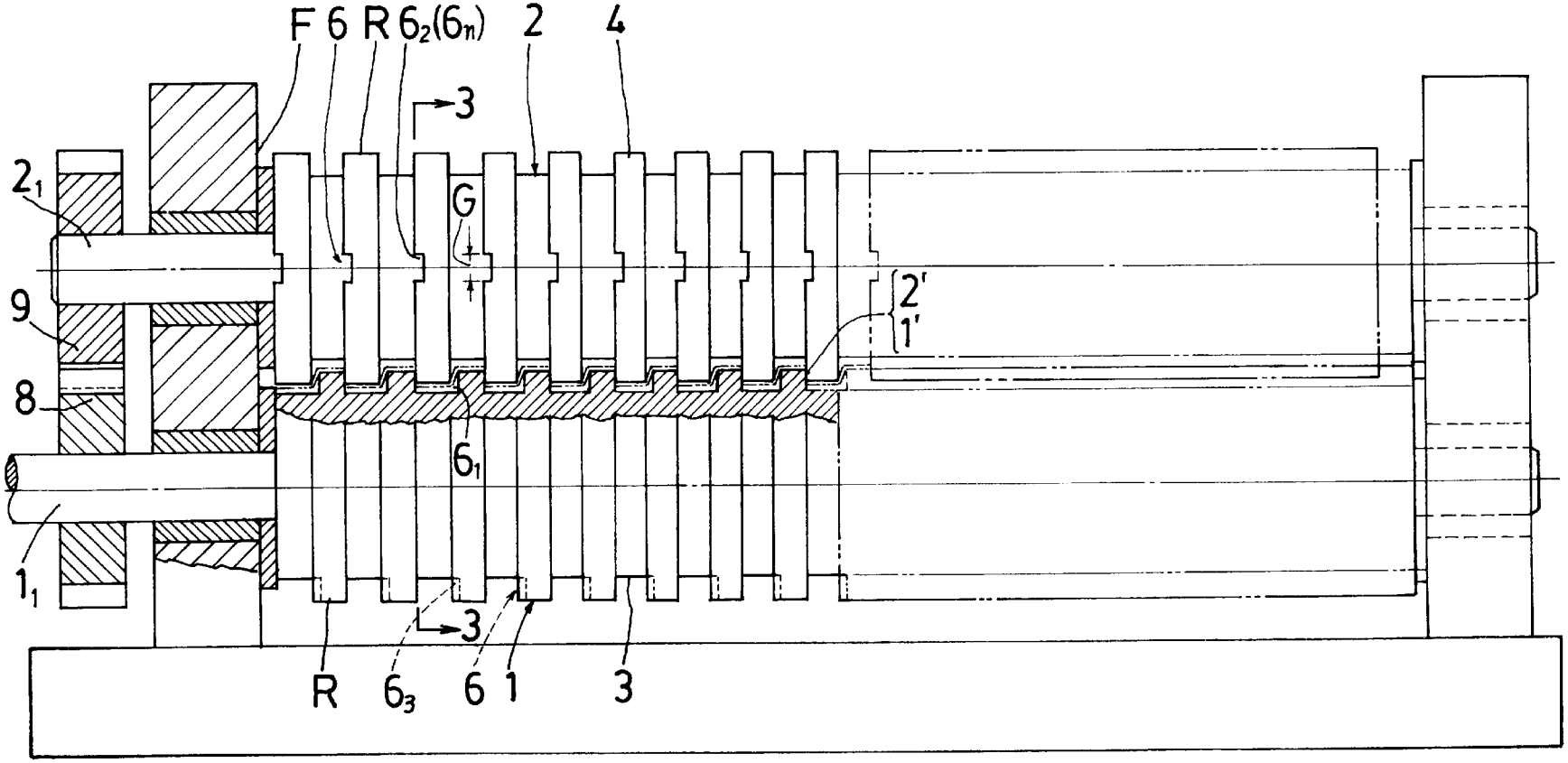
FIG. 1 is a front view of one example of an apparatus for manufacturing paper cushioning members according to the present invention.
Figure 2:
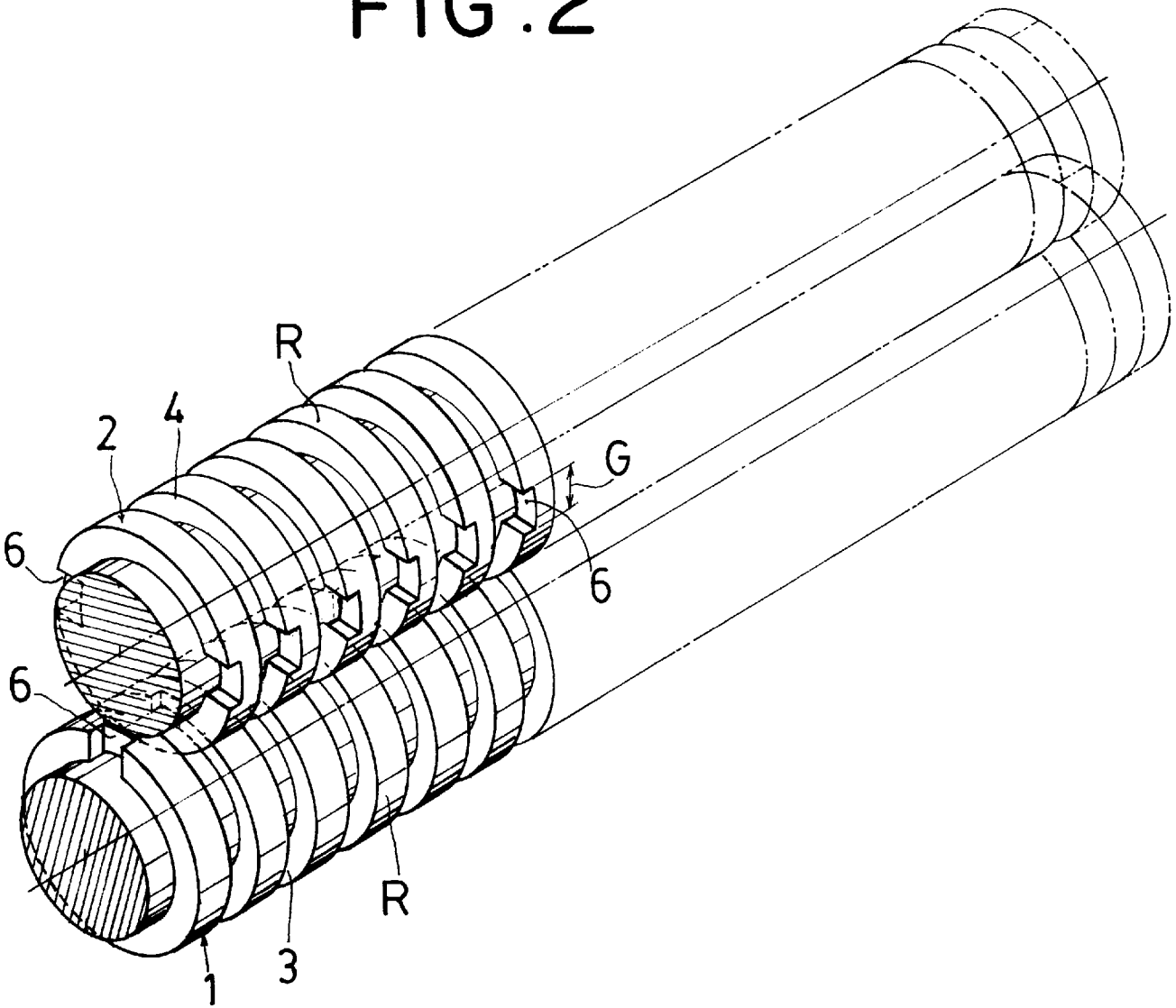
FIG. 2 is a perspective view of a pair of elongated roller members in FIG. 1.
Figure 3:
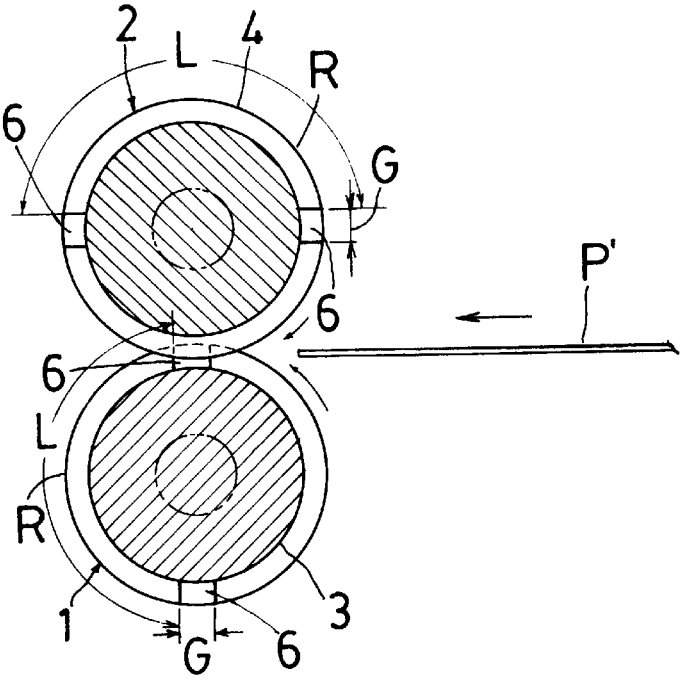
FIG. 3 is a cross-sectional view taken along the line 2—2 in FIG. 1.
Figure 4:
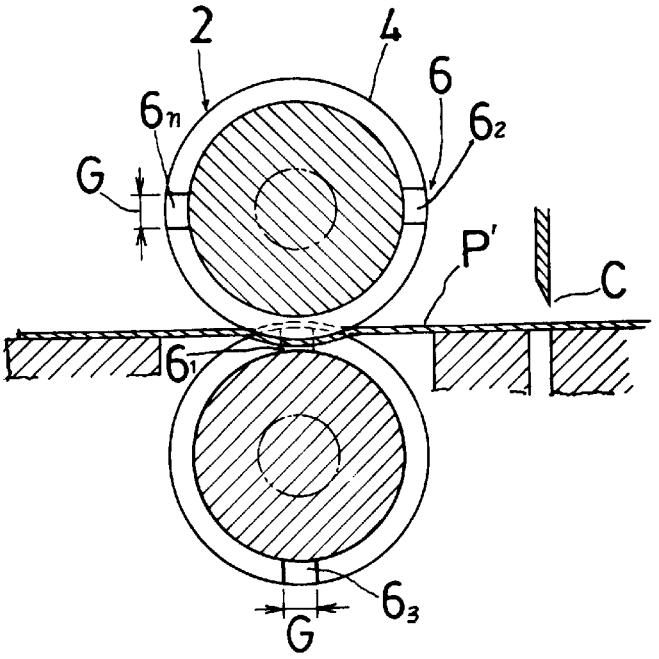
FIG. 4 is a cross-sectional view showing how work paper in FIG. 3 is processed.

Preferred embodiments of the present invention will now be described referring to the accompanying drawings.

In FIGS. 1, 7, 9 and 10, reference numerals "1" and "2" denote a pair of elongated steel roller members whose shaft portions 11 and 21 at both ends supported on a frame F by means of bearings.

Cutting blades 1' and 2' are formed at the peripheral edges of the circumferential surfaces R of circumferential projections formed on the roller members 1 and 2.

Reference numerals "3" and "4" respectively denote rectangular, circumferential recesses and projections a given width (allowed to be about 5 mm), which are formed on each of the roller members 1 and 2. The circumferential recesses 3 of one roller member engage with the circumferential projections 4 of the other roller member, while the circumferential projections 4 of the former roller member engage with the circumferential recesses 3 of the latter roller member.

Reference numeral "5" is a plate-shaped barrier provided on that side of the roller member pair 1 and 2 where work paper to be processed is to be discharged. The barrier 5 is disposed in a box-shaped container 10 in such a manner that its forward and backward movements are adjusted via a shaft $\mathbf{5}_2$ by a spring $\mathbf{5}_1$.

Figure 10:
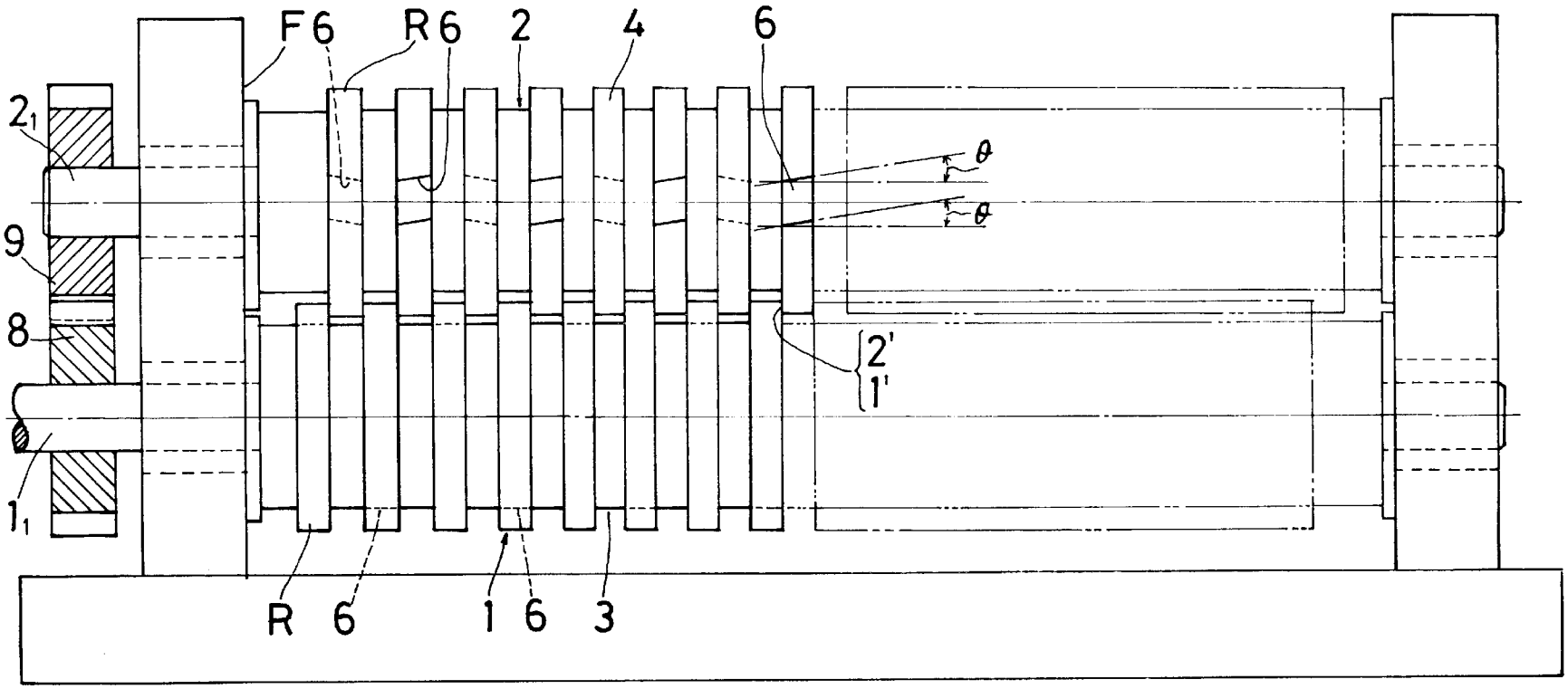
FIG. 10 is a front view showing a still further example of the apparatus for manufacturing paper cushioning members according to the present invention.
Figure 11:
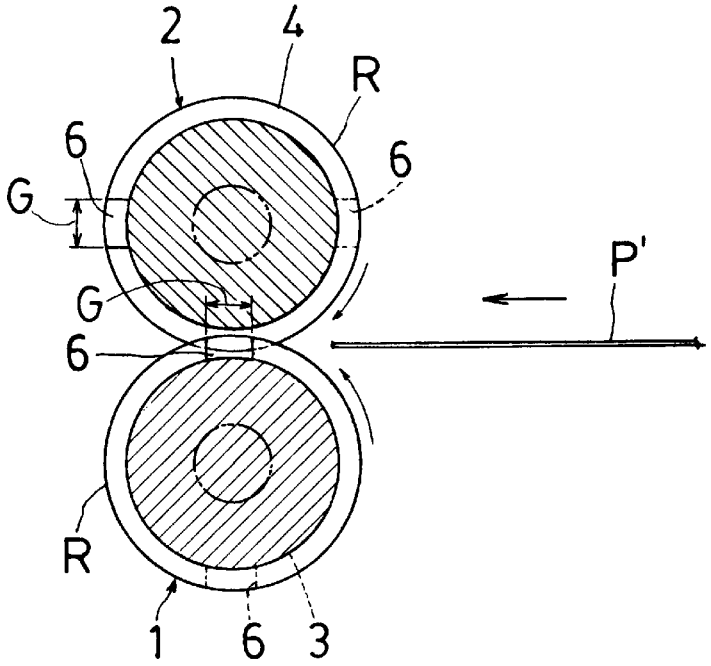
FIG. 11 is a cross-sectional view taken along the line 11—11 in FIG. 7.

Each projection 4 of each roller member has link-portion forming recesses 6 each formed in a part of its circumferential surface in the horizontal direction or at a predetermined angle θ to the horizontal direction (about 1 to 10 degrees in FIG. 10). The length L of each projection 4 and the length G of each link-portion forming recess 6 can be set arbitrarily; in the example of FIG. 1, the length L is set to 50 mm while the length G is set to 7 mm. In this case, when the link-portion forming recess 6 of one, reference projection 3 of the lower roller member 1 comes to the top, the link-portion forming recesses 6 of the adjoining projections 3 come to the bottom.

Figure 7:
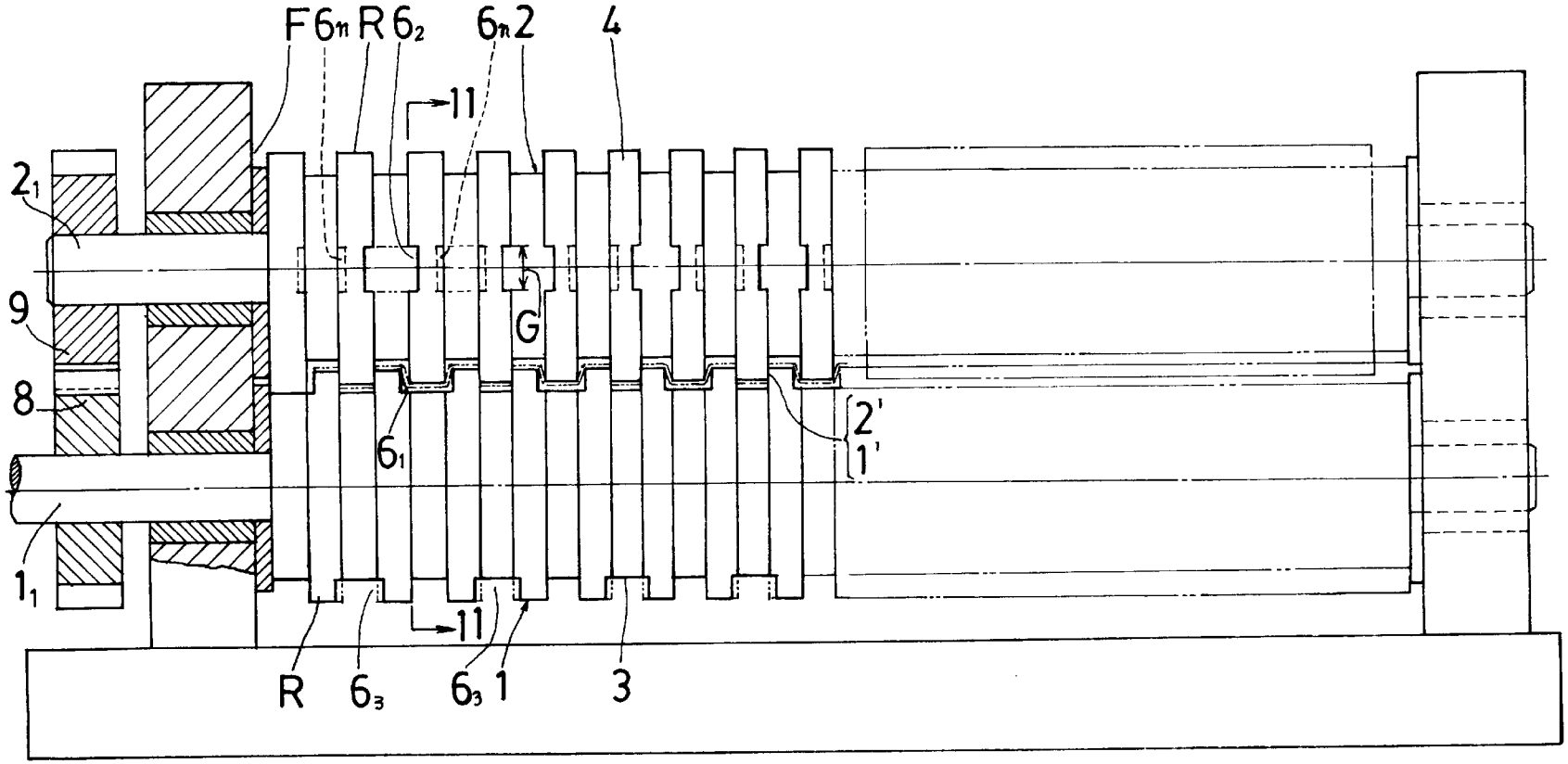
FIG. 7 is a front view of another example of the apparatus for manufacturing paper cushioning members according to the present invention.
Figure 8:
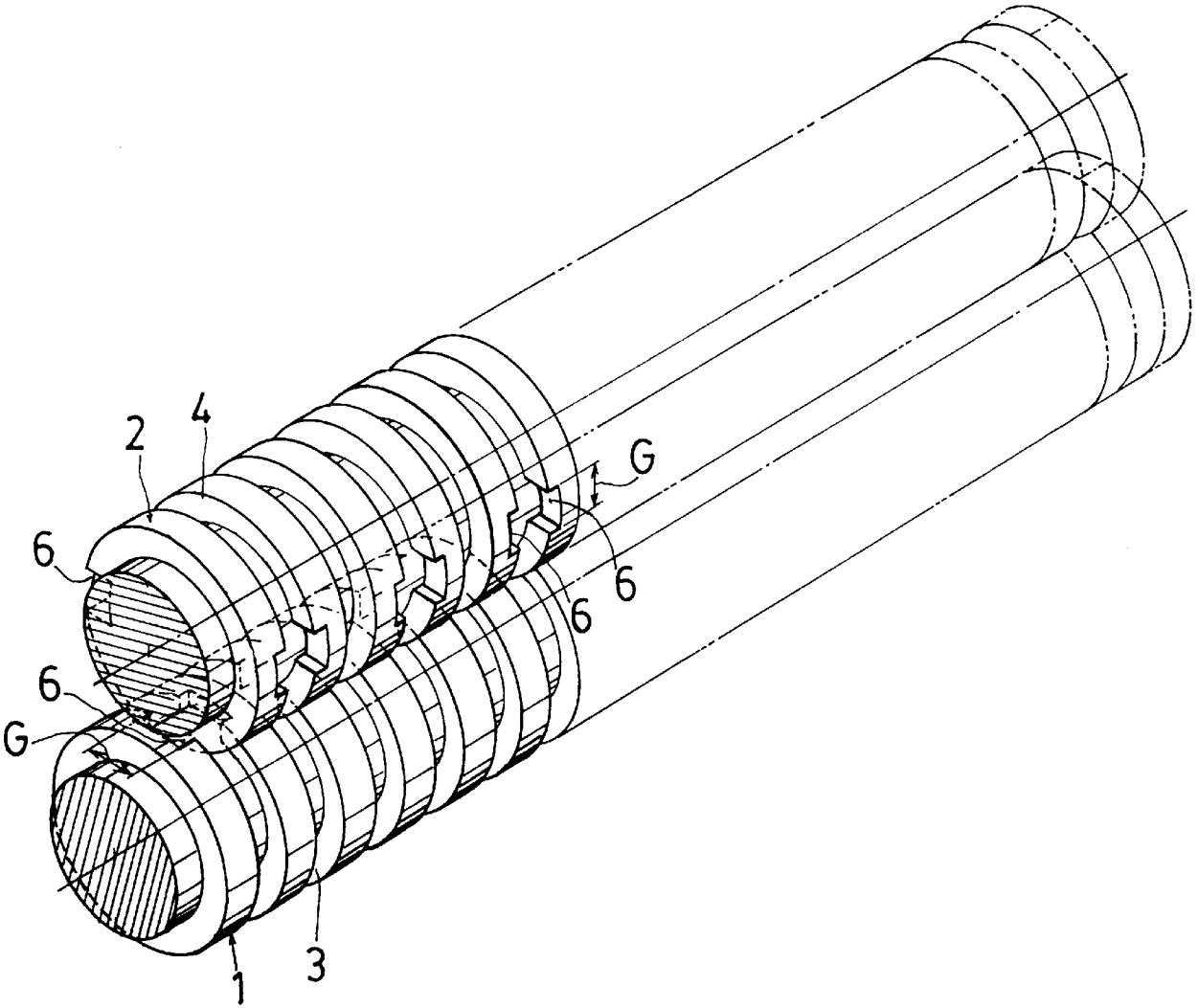
FIG. 8 is a perspective view of a pair of elongated roller members in FIG. 7.
Figure 9:
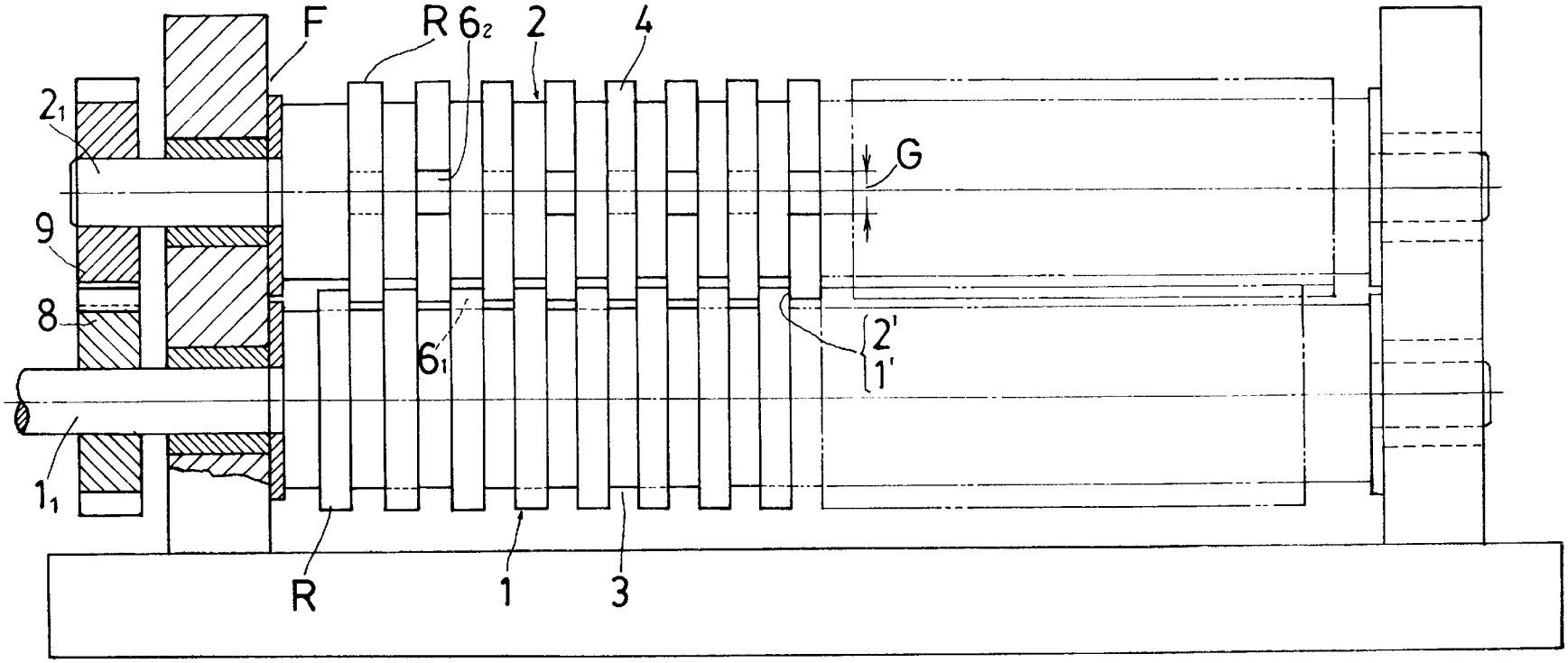
FIG. 9 is a front view showing a further example of the apparatus for manufacturing paper cushioning members according to the present invention.

In the examples of FIGS. 7, 9 and 10, if the lengths between the link-portion forming recesses of one roller member are set to 75 mm, the lengths between the associated link-portion forming recesses of the other roller member are set to 25 mm.

FIG. 1 illustrates the link-portion forming recesses 6 of the circumferential projections 4 of each roller member formed to all face in one direction. The link-portion forming recesses 6 shown in FIG. 7 are formed in the opposite surfaces of the adjacent circumferential projections 4. The link-portion forming recesses 6 in FIG. 9 are formed entirely across the circumferential projections 4 in the horizontal direction. The link-portion forming recesses 6 in FIG. 10 are formed in the circumferential projections, slightly inclined at a predetermined angle θ (about 1 to 10 degrees in the illustrated example) to the horizontal direction.

Reference numeral "7" denotes cuts formed in work paper P' at a given width W (5 mm in the illustrated examples) by the pair of roller members 1 and 2. Reference numerals "$\mathbf{7}_1$," "$\mathbf{7}_2$," "$\mathbf{7}_3$," . . . "$\mathbf{7}_n$" denote link portions which link the associated cuts 7 together. The cuts 7 and the link portions $\mathbf{7}_1$ to $\mathbf{7}_n$ are set by the intermittent recesses of the circumferential recesses and projections 3 and 4 of the roller members 1 and 2 and the lengths between the intermittent recesses.

Figure 5:
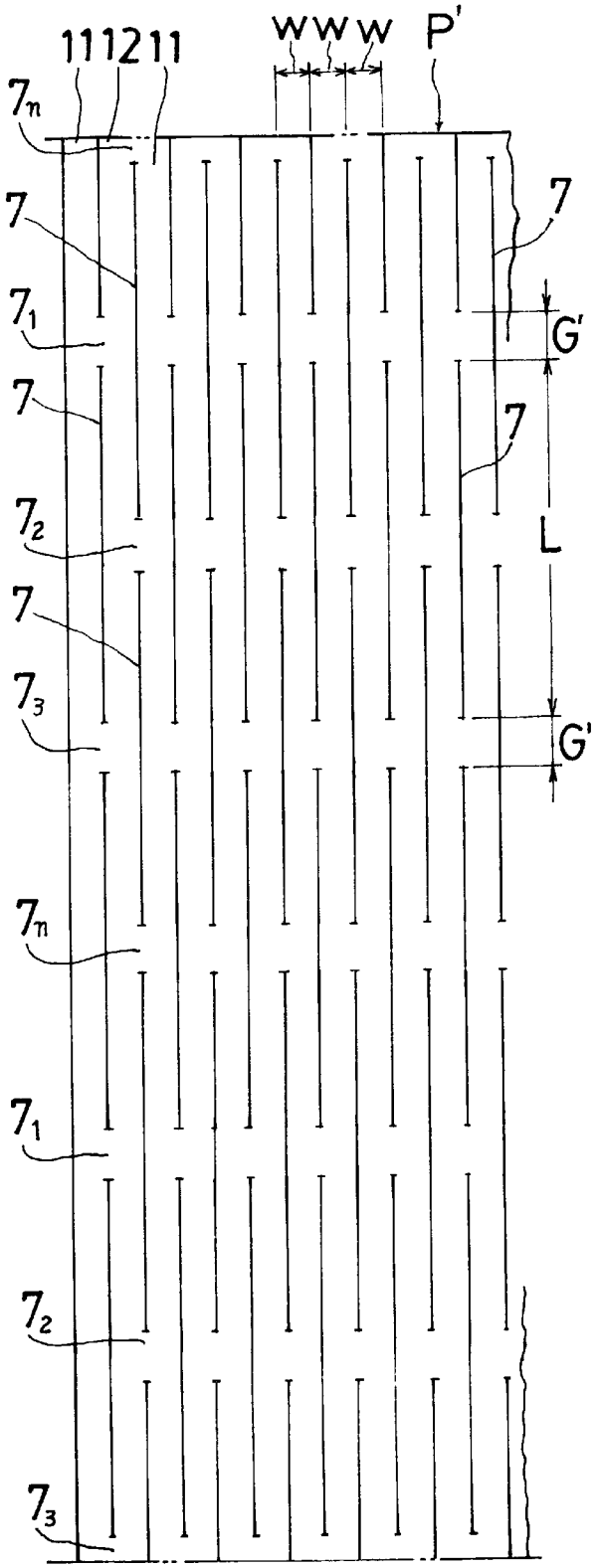
FIG. 5 is a plan view showing that intermittent thin bands having cuts and link portions are formed on the work paper by the roller members in FIG. 1.

In the example of FIG. 5, under the aforementioned condition, two adjoining thin bands 11 and 12 are linked by the cutting length for the work paper P', L=50 mm, and the length of the link portions $\mathbf{7}_1$–$\mathbf{7}_n$, G'=7 mm.

Figure 13:
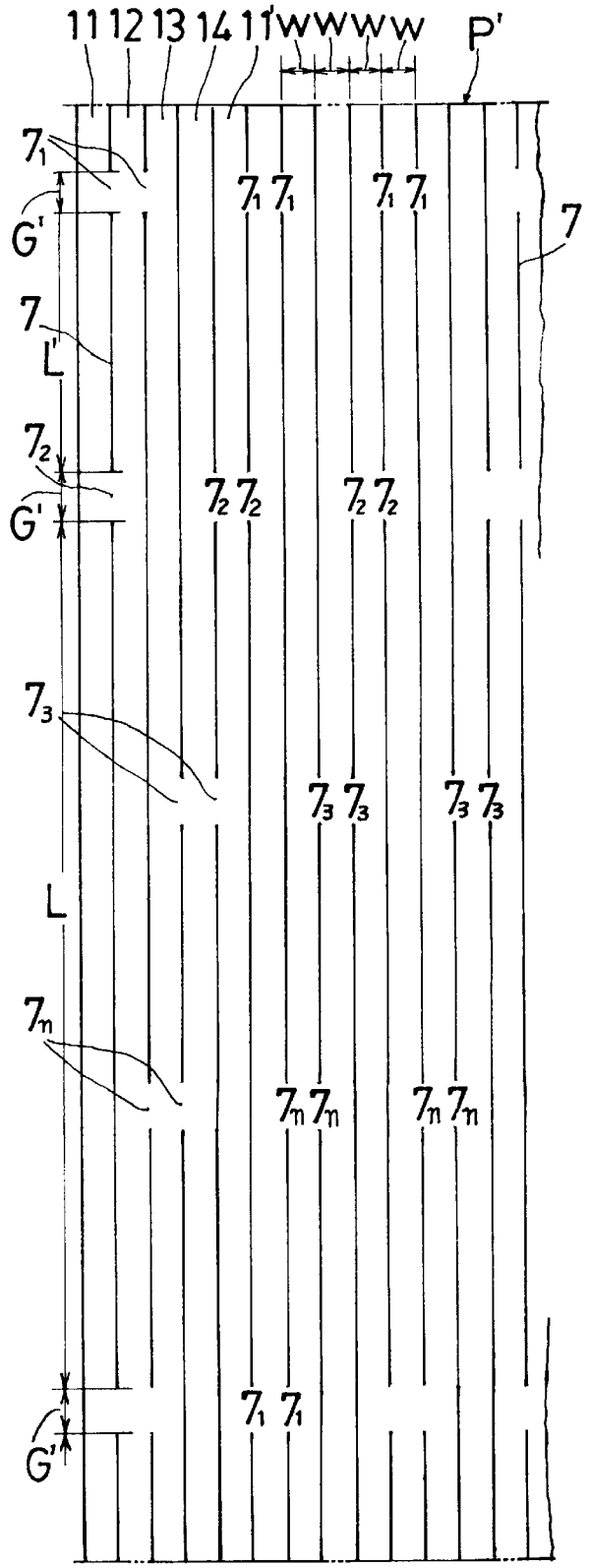
FIG. 13 is a plan view showing that intermittent thin bands having cuts and link portions are formed on the work paper by the roller members shown in FIGS. 7 and 9.

In the example of FIG. 13, if the length between the long cuts in the work paper P' is set to 75 mm, the length between the short cuts in set to 25 mm, and three adjoining thin bands 11, 12 and 13 are linked by the length G' of the individual link portions $\mathbf{7}_1$–$\mathbf{7}_n$, G' set to 7 mm.

That is, FIG. 5 shows two thin bands linked by single link portions $7_1, \ldots, 7_n$, while FIG. 13 shows three thin bands linked by two link portions $7_1$ and $7_1, \ldots, 7_n$ and $7_n$.

In the diagrams, reference numerals "8" and "9" are gears, which are attached to the shafts $1_1$ and $2_1$ of the roller members 1 and 2 and are engaged with each other to transmit power. Power from a motor (not shown) is transmitted to one of the gears, 8, through a belt or a chain.

"C" indicates a cutter provided on the work-paper supplying side of the roller members 1 and 2 to cut the work paper P', fed by those roller members 1 and 2, to a given length.

Reference numeral "15" denotes a box-shaped container for retaining processed, net-like paper cushioning members. The container 15 has a take-out port $15_1$ formed in the front to have such a size as to allow insertion of one hand, and retain many processed, net-like paper cushioning members with that side of the net-like paper cushioning members along the cutting length facing perpendicular to the take-out port $15_1$.

Figure 18:
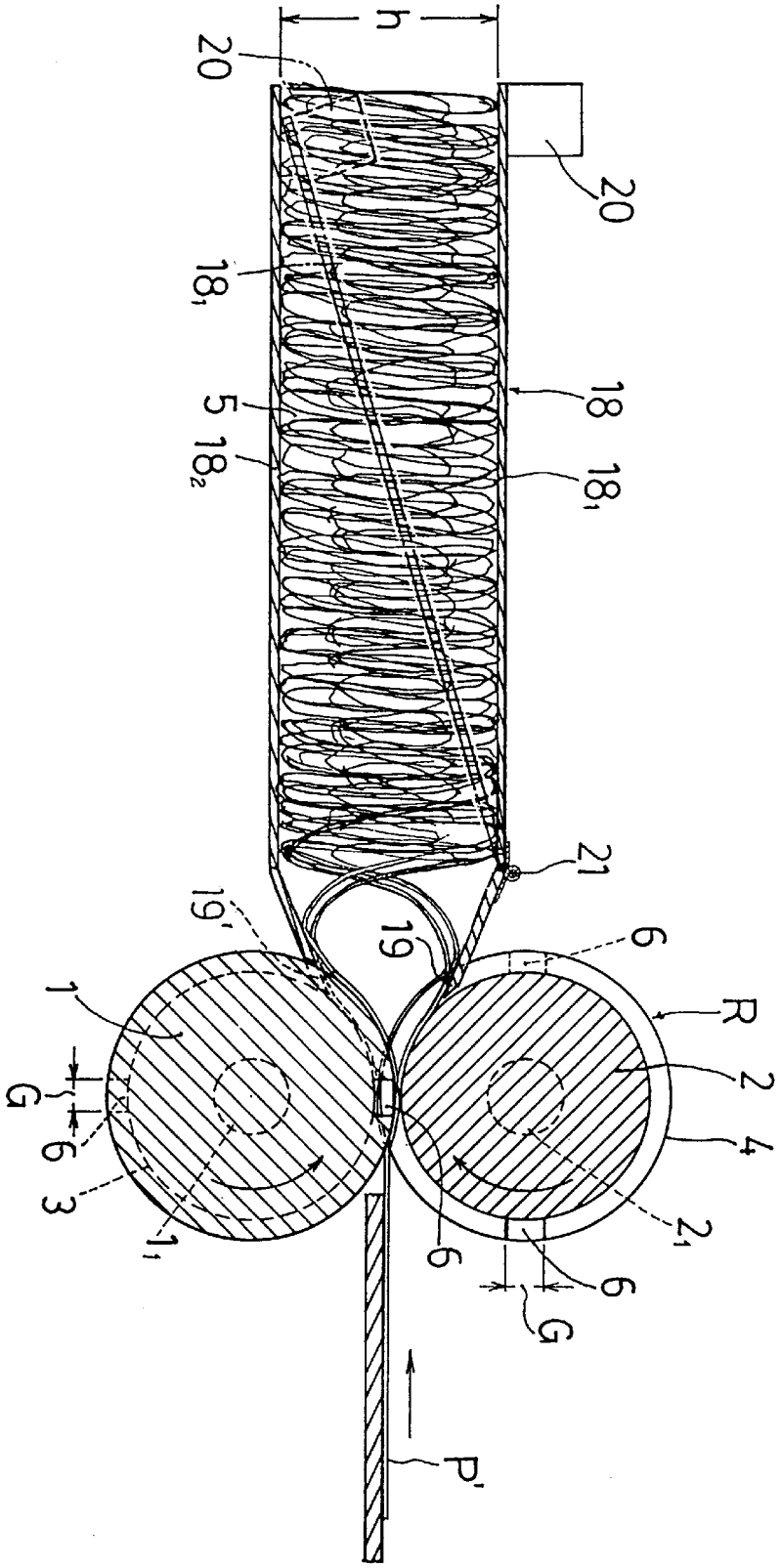
FIG. 18 is a vertical cross-sectional side view at the center taken along the line 18—18 in FIG. 17, showing the work paper to be processed in a wavy state.

A wave-forming guide 18, for processed work paper, is located on the discharge side of the elongated steel roller members 1 and 2 in the lead-in direction thereof, as shown in FIG. 18. The wave-forming guide 18 comprises an upper pressing member $18_1$ and a lower receiving member $18_2$, and defines waste-collecting members 19 and 19', which have projections and recesses formed on respective roller-member side edge portions thereof which mate with the recesses and projections of the roller members 1 and 2. Formed in the wave-forming guide is a passage 5 of a predetermined height h which has a certain relation with the circumferential length of the roller members 1 and 2. More specifically, given that the circumferential length of the projections of the roller members 1 and 2 is set to about 132 mm, one unit cut length is set to 99 mm, the other unit cut length is set to 33 mm and the length of the link-portion forming recess is set to 6 mm, the height h of the passage 5 of the wave-forming guide is set to about 33 mm. As described in the present example, one unit cut length is approximately three-fourths that of the circumferal length of the projections of the roller members 1 and 2, and the other unit cut length is approximately one-fourth that of the circumferal length of the projections of the roller member 1 and 2.

The upper pressing member $18_1$ has its base attached to be rotatable about a hinge 21, with a weight 20 provided at the outlet portion of the upper pressing member $18_1$. When unprocessed work paper P' does not pass the upper pressing member $18_1$, the passage 5 is narrowed by the distal end portion of the upper pressing member $18_1$. However, when processed work paper passes the upper pressing member $18_1$, the paper moves against the weight 20, thereby being compressed by the narrow, yet gradually widening passage 5. The paper P' is discharged in waves formed with a height the same as height h of passage 5. In this case, the recesses and projections of the roller members 1 and 2 form waves (i.e., when the paper on the lower roller member side waves upward, the adjacent portion of the paper on the upper roller member side waves downward), and the thin bands are finely crumpled unit by unit.

Figure 17:
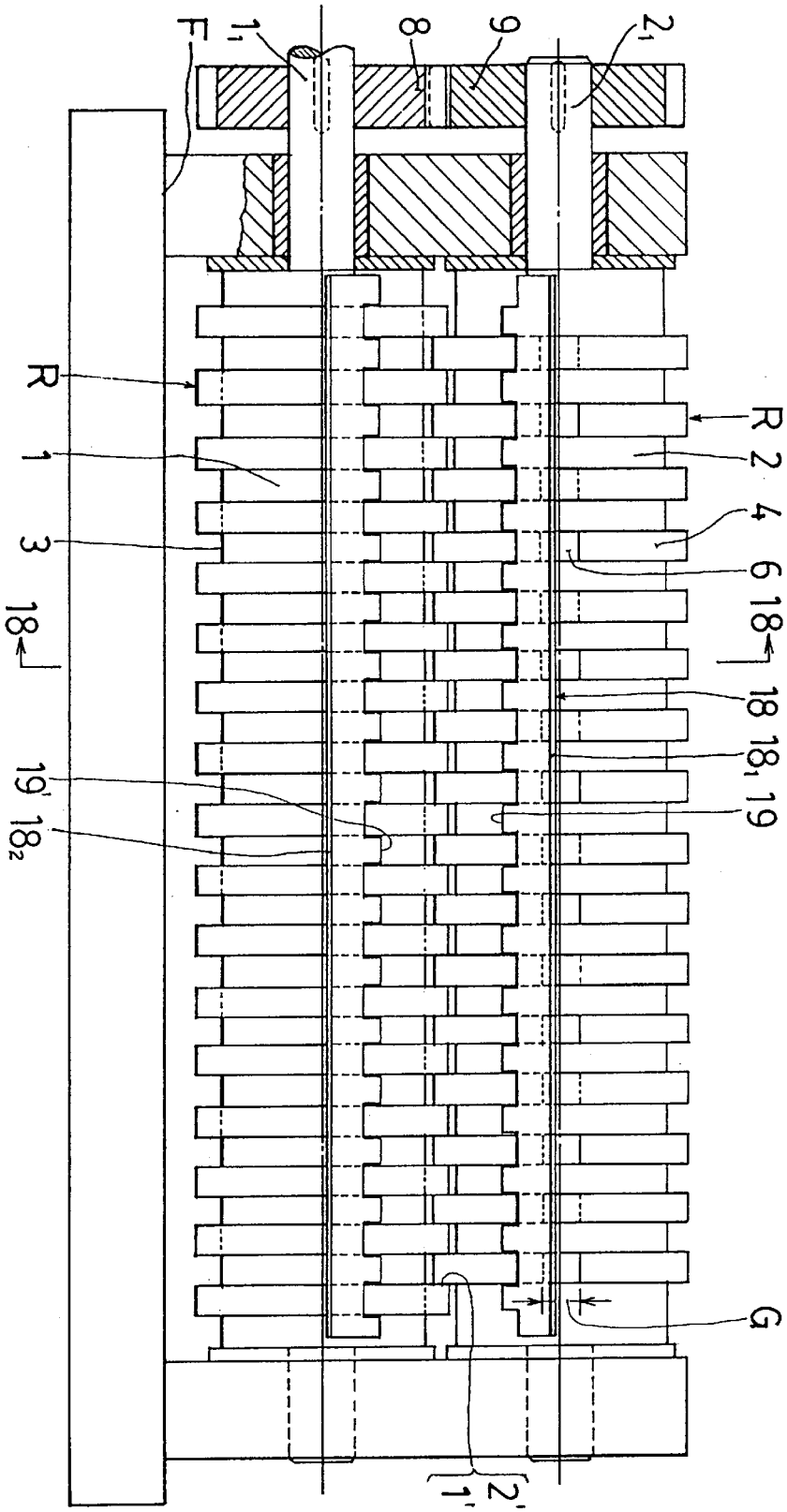
FIG. 17 is a front view showing a wave-forming guide provided on the discharge side of the elongated roller members where work paper to be processed is discharged.

Specific examples of the paper-cushioning member manufacturing steps of this invention will now be described. In the first embodiment shown in FIGS. 1 through 5, the cutting blades 1' and 2' of a given width are formed on the roller member pair 1 and 2, the link-portion forming recesses 6 are formed in the circumferential surface R of each projection 4 in the same direction, and the recesses 3 and projections 4 of one roller member are engaged with the projections 4 and a single sheet or plural sheets of work paper P' of a predetermined length, such as unused paper or unnecessary newspaper, used copying paper, paper printed by an OA equipment or used corrugated cardboard, are inserted in the engaging portion between the roller members 1 and 2, the cuts 7 and link portions $7_1(7_2, \ldots, 7_n)$ are alternately formed along the cutting blades 1' and 2', so that one row of cuts 7 and single link portions $7_1$ $(7_2, \ldots, 7_n)$ are formed for two rows of thin bands 11 and 12. The processed paper which passes through roller members 1 and 2 tends to stick to the outer surface of each roller member, particularly, the portions of the paper in the recesses. However, the paper to be processed, as shown in FIGS. 17 and 18, is discharged straight and inserted in the wave-forming guide 18 by waste-collecting members 19 and 19' having the projections and recesses. The paper in the recesses of the lower roller member 1, when separated by the lower waste-collecting member 19', moves upward, while the paper in the recesses of the upper roller member 2, when separated by the upper waste-collecting member 19, moves downward. As the paper moves toward the end of guide passage 5 that is narrowed by the weight 20, it is compressed, forming the entire thin bands into waves a in the guide passage 5 within the height h and finely crumpling each unit of thin bands. When the upper pressing $18_1$ rotates upward and about the hinge 21 and against the weight 20, the paper is discharged from the outlet of the wave-forming guide 18 while stretching the passage 5.

A number of processed, net-like paper cushioning members P having those cuts and link portions are retained one on another in the container 15 through an openable/closable cover $15_2$ at the top. In this case, the net-like paper cushioning members P are retained with the lengthwise direction of the cuts 7 set perpendicular to the take-out port $15_1$.

Figure 6:
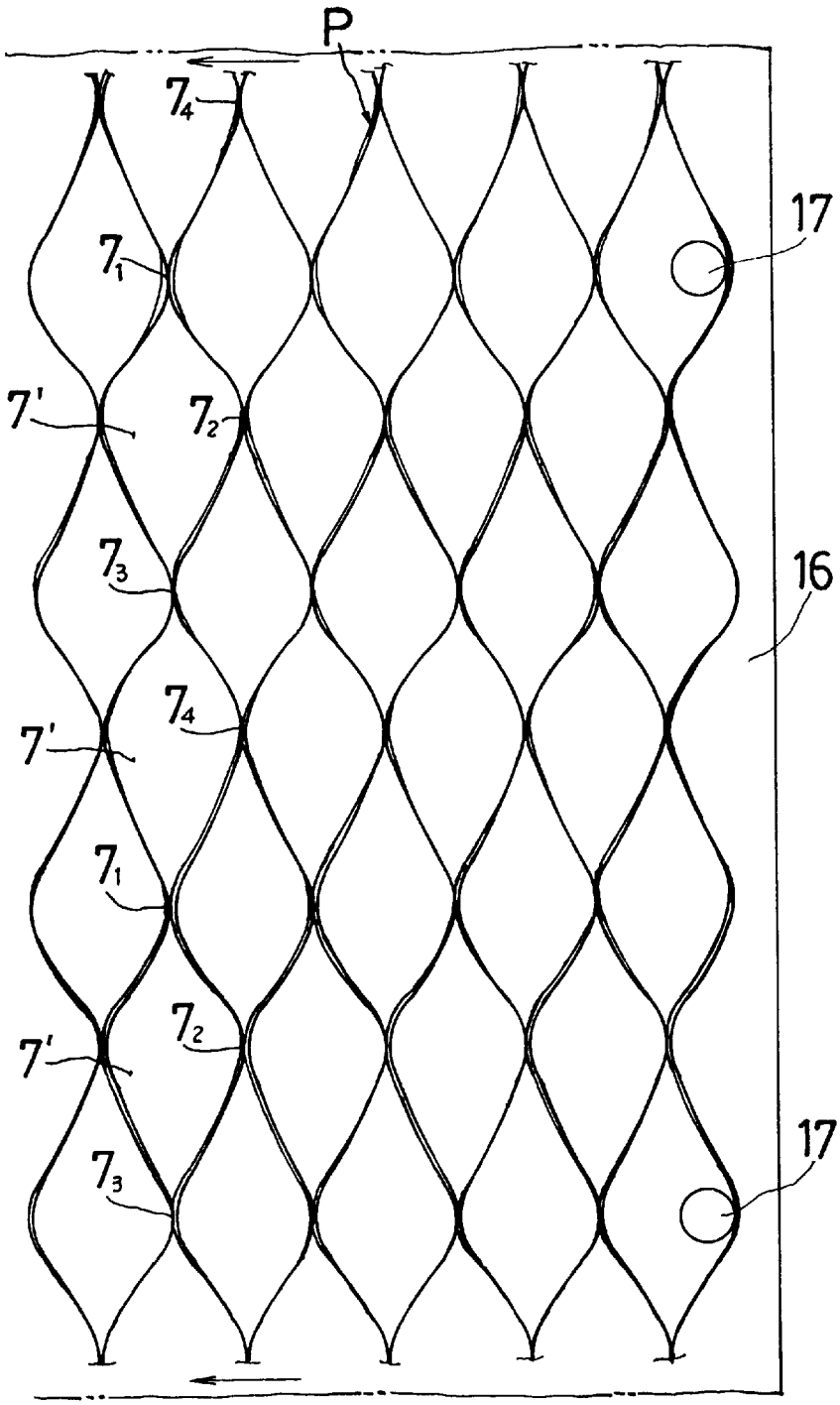
FIG. 6 is a perspective view showing the intermittent thin bands in FIG. 5 stretched to form a net.
Figure 14:
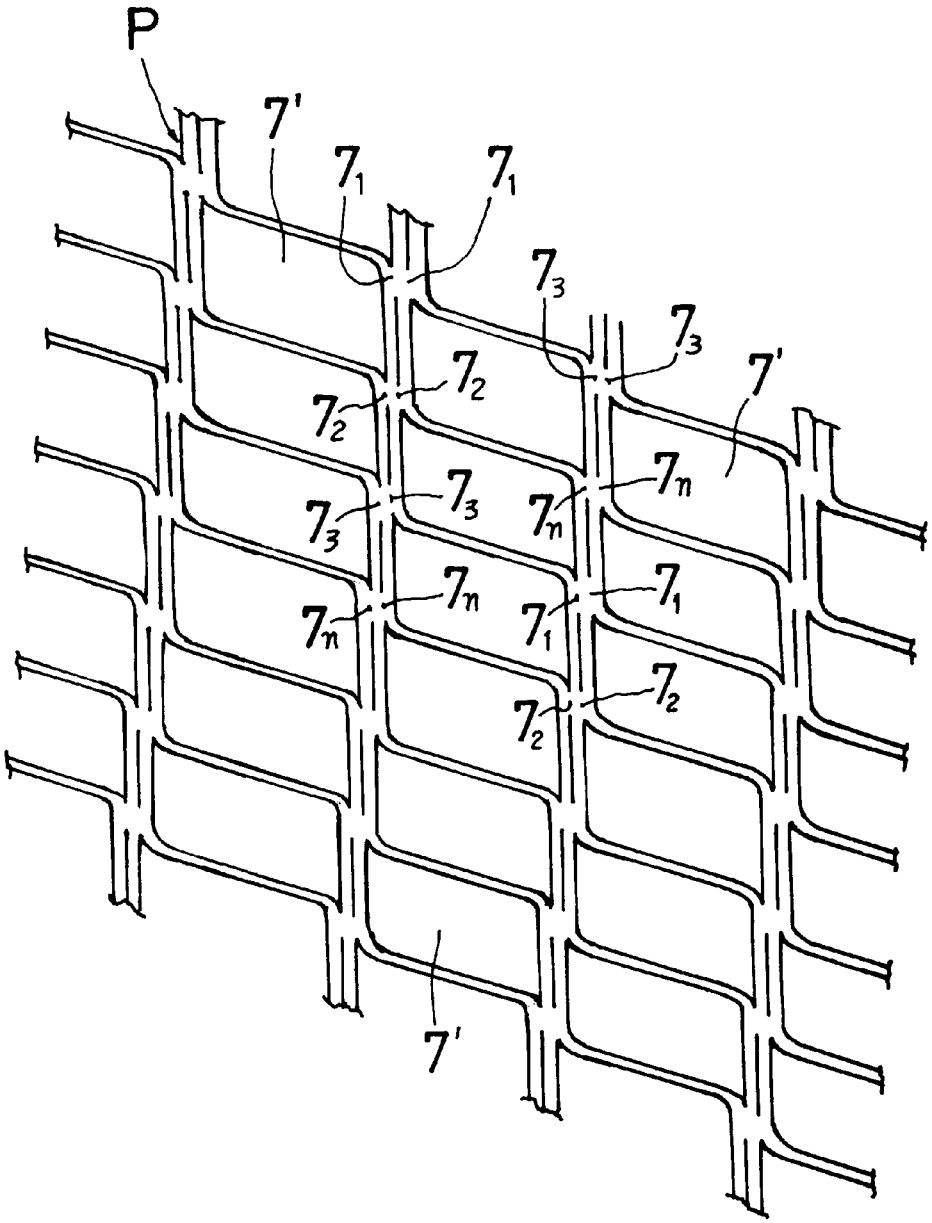
FIG. 14 is a perspective view showing the intermittent thin bands in FIG. 13 stretched to form a net.
Figure 15:
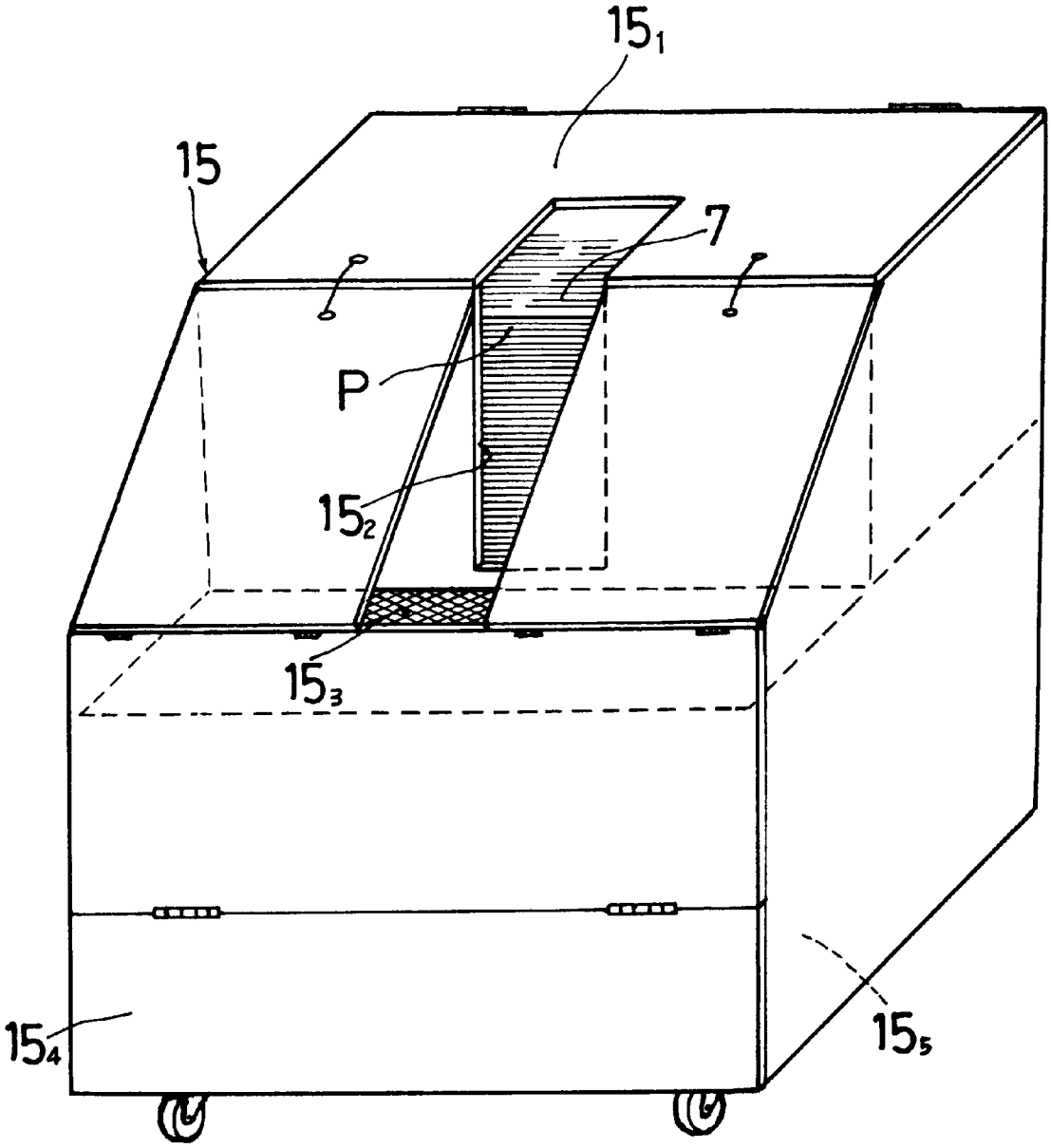
FIG. 15 is a perspective view showing processed paper cushioning members retained in a box-shaped container having a take-out port.
Figure 16:
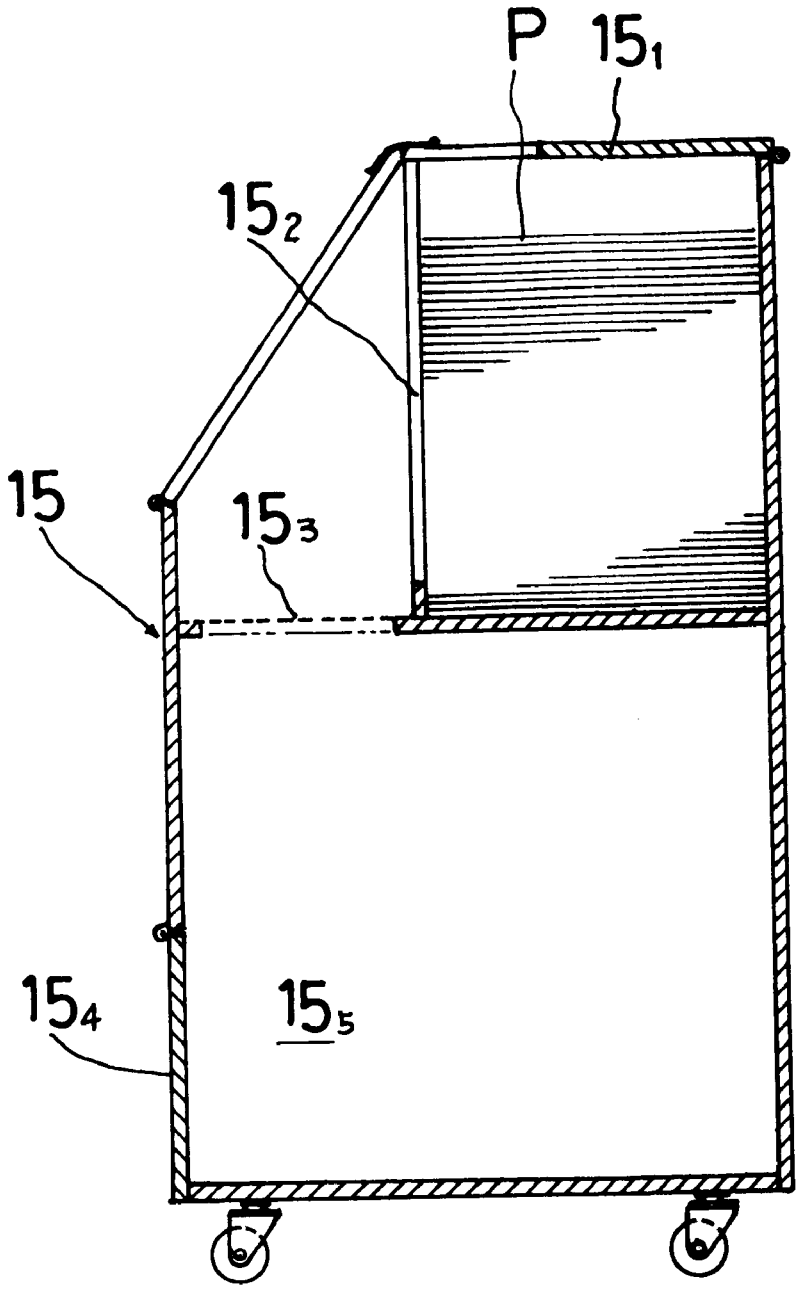
FIG. 16 is a center vertical cross-sectional view of the container in FIG. 15.

When a desired number of net-like paper cushioning members P are pulled out of the container 15 by one hand inserted through the take-out portion $15_1$, the cuts 7 are stretched with the net-like paper cushioning members P slightly tightened at the take-out port $15_1$, thus yielding the net 7' having the cuts 7 widened to the size as shown in FIG. 6 (or FIG. 14). In this case, the wastes of the net-like paper cushioning members P contacting the take-out port $15_1$ fall downward into a paper waste room $15_5$ through a mesh $15_3$ provided immediately in front of the take-out port $15_1$. A lot of paper wastes retained in the room $15_5$ will be discharged out of the container 15 by opening an openable/closable cover $15_4$ provided at the front bottom portion of the container 15. As the net-like paper cushioning members P are placed one on another on a table 16 and the net-like paper cushioning members P are pulled in the direction of the arrows when in use, with parts of the net 7' hooked on fixed shafts 17, the widened net will be yielded.

In the second embodiment shown in FIGS. 7 through 10, the cutting blades 1' and 2' of a given width are formed on the roller member pair 1 and 2, the link-portion forming recesses 6 are formed, facing each other, in the circumferential surfaces R of the adjoining projections 4, and the recesses 3 and projections 4 of one roller member are engaged with the projections 4 and recesses 3 of the other roller member respectively. When a single sheet or plural sheets of work paper P', such as unused paper or unnecessary newspaper, used copying paper, paper printed by an OA equipment or used corrugated cardboard, are inserted in the engaging portion between the roller members 1 and 2, the cuts 7 and link portions $7_1$ $(7_2, \ldots, 7_n)$ are alternately formed along the cutting blades 1', so that two rows of cuts 7 and two link portions $7_1$ and $7_1$ ($7_2$ and $7_2$, . . . , $7_n$ and $7_n$) are formed for three rows of thin hands 11, 12 and 13. Then, the resultant sheet or sheets of work paper are stretched in a direction perpendicular to the cutting direction, thus providing a net 7' having the cuts 7 of the size as shown in FIG. 6 or 14.

A number of processed, net-like paper cushioning members P having those cuts and link portions formed in this manner are retained one on another in the container 15.

Figure 12:
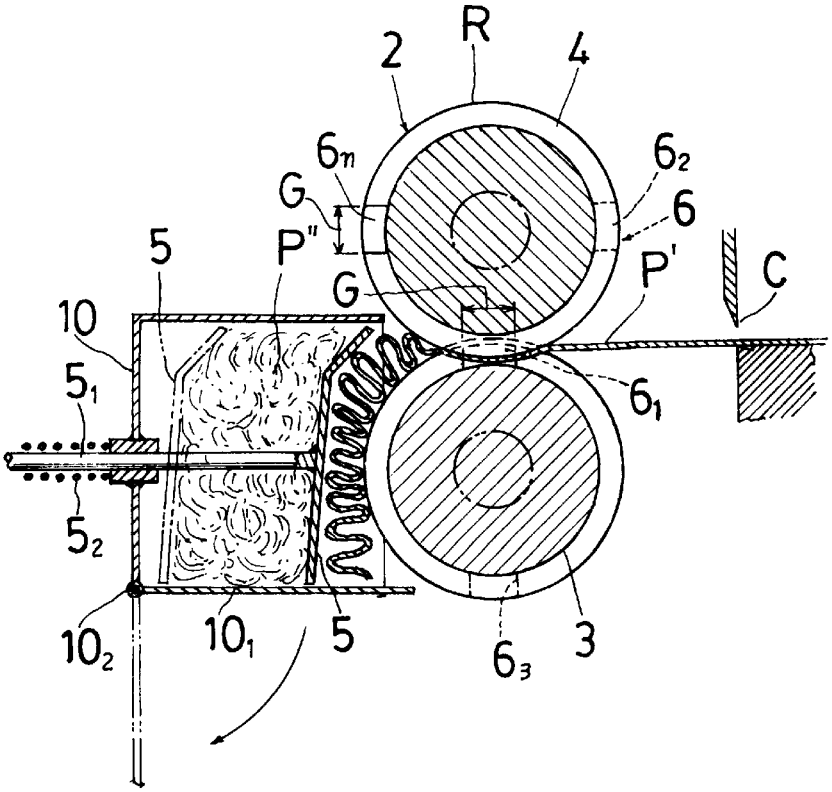
FIG. 12 is a cross-sectional view showing how work paper in FIG. 11 is processed.

If a container 10 is provided on the discharging side of the roller members 1 and 2 as needed as shown in FIG. 12, the work paper P' is sent to the container 10, hitting against the barrier 5 in that container. The barrier 5 is shifted backward by a set amount by the spring in accordance with the discharging amount and is held there. Then, the work paper P' on the feeding side is cut by the cutter C at a given length L. When a set amount of the work paper P' is retained, a bottom plate $10_1$ is opened around a hinge $10_2$ to drop paper chunks P".

If there is a chance that the work paper P', if it is old newspaper, printed paper or similar paper, is stained by printed ink or the like, a poly bag should be set below the barrier 5, so that the discharged, crumpled paper members will be retained in the poly bag, contributing to preventing the products from being stained.

In the third embodiment shown in FIG. 13, the cutting blades 1' and 2' of a given width are formed on the roller member pair 1 and 2, the link-portion forming recesses 6 are formed across the circumferential surfaces R of the adjoining projections 4 in the horizontal direction.

In the fourth embodiment shown in FIG. 14, the cutting blades 1' and 2' of a given width are formed on the roller member pair 1 and 2, the link-portion forming recesses 6 are formed in the circumferential surfaces R of the adjoining projections 4, inclined at a predetermined angle θ to the horizontal direction.

With the above-described structure, according to the present invention, various types of paper members, when cut, will not be scattered around and no chemicals are used to provide necessary paper cushioning members, thus overcoming the conventional problem of pollution.

As paper cutting is done by a pair of elongated roller members, a stack of sheets of ordinary work paper, such as newspaper, used copying paper, or printed paper, can be processed together to provide a relatively large net.

The processed, bundles of net-like paper cushioning members when in use may be retained one on another in the units of 10 kg per bundle, making the transpiration and storage of the paper cushioning members convenient. Further, the cuts are widened to form a net by simply pulling a desired number of paper cushioning members out from the take-out port at the front of the container. The resultant nets have only to be crumpled with hands to continuously mass-produce cushions or packings with adequate softness.

When the net-like paper cushioning members intermittently cut by a pair of roller members are crumpled into paper chunks by the barrier, the crumpled paper cushioning members absorb a larger amount of air, so that the paper cushioning members become softer.

Furthermore, a mechanism for cutting the processed paper cushioning member, already intermittently cut by a pair of roller members, to a predetermined length may be provided to always produce paper cushioning members with the same volume and constant quality.

In addition, if the link-portion forming recesses are formed, inclined at a predetermined angle with respect to the horizontal direction as shown in FIG. 14, the link-portion forming recesses obliquely come in contact with the recess surfaces of the associated link-portion forming recesses, preventing overstrain from being applied to the paper members. This design suppresses the wearing of the blades and is very advantageous.

At the time the processed paper is cut by the roller members, the processed paper, particularly the thin bands located in the recesses, tends to stick to the roller surfaces. Accordingly, the waste-collecting members are disposed to remove any paper that may stick to the roller members. Additionally, the waste-collecting members can actually separate the thin bands.

The processed paper with intermittent cuts, when stretched, forms a large net, as shown in FIG. 6. When the paper in this state is crumpled, softer cushioning members accompanied with a larger amount of air can be obtained.

Further, when the processed paper with intermittent cuts is discharged to the wave-forming guide, the entire thin bands are made wavy and each unit of thin bands is finely crumpled. The processed paper can have a significant height in the direction of the thickness of the paper. The resultant paper, even without being processed any further, can serve as effective cushioning members.

What is claimed is:

1. An apparatus for manufacturing paper cushioning members, comprising:

a pair of elongated roller members each having first circumferential recesses and projections of a given width thereon and therearound, such that said first recesses and projections of respective rollers engage with one another, said first circumferential projections each having a circumferential length;

cutting blades formed at peripheral edges of surfaces of said first circumferential projections;

link-portion forming recesses formed in parts of mating circumferential surfaces of said first projections entirely across said first circumferential projections in a horizontal direction, one unit cut length being about three fourths of said circumferential length of said first projections and another unit cut length being about one-fourth of said circumferential length of said first projections;

a wave-forming guide including a top-pressing member and a bottom-receiving member, both located on a discharge side of said roller members;

said wave-forming guide having a passage with a height being set to about one-fourth of said circumferential length of said first projections;

waste-collecting members having second projections and recesses formed on edge portions thereof which engage with said first recesses and projections of said rollers; and a weight provided at an outlet portion of said top-pressing member.

* * * * *